US011628669B2

(12) United States Patent
Yoshida et al.

(10) Patent No.: US 11,628,669 B2
(45) Date of Patent: Apr. 18, 2023

(54) LIQUID DISCHARGE HEAD, LIQUID DISCHARGE DEVICE, AND LIQUID DISCHARGE APPARATUS

(71) Applicant: RICOH COMPANY, LTD., Tokyo (JP)

(72) Inventors: Takahiro Yoshida, Kanagawa (JP); Takashi Kinokuni, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 59 days.

(21) Appl. No.: 17/362,169

(22) Filed: Jun. 29, 2021

(65) Prior Publication Data

US 2022/0032621 A1 Feb. 3, 2022

(30) Foreign Application Priority Data

Jul. 28, 2020 (JP) ..... JP2020-127499

(51) Int. Cl.
*B41J 2/14* (2006.01)

(52) U.S. Cl.
CPC ..... *B41J 2/14233* (2013.01); *B41J 2/14072* (2013.01); *B41J 2002/14491* (2013.01)

(58) Field of Classification Search
CPC ..... B41J 2/14233; B41J 2/14072; B41J 2002/14491; B41J 2002/14362; B41J 2202/12; B41J 2/14274
See application file for complete search history.

(56) References Cited

U.S. PATENT DOCUMENTS

2017/0348973 A1 12/2017 Yoshiike
2018/0257374 A1 9/2018 Yoshida et al.
2018/0272709 A1 9/2018 Iwata et al.
2018/0272739 A1 9/2018 Sawase et al.
2018/0272743 A1 9/2018 Nakai et al.
2019/0084313 A1 3/2019 Kohda et al.
2019/0240978 A1 8/2019 Kawahara et al.
2019/0263119 A1 8/2019 Odaka et al.
(Continued)

FOREIGN PATENT DOCUMENTS

JP 2017-164917 9/2017
JP 2018-086827 6/2018

OTHER PUBLICATIONS

IP.com search (Year: 2022).*
Machine Translation of JP 2004262203 A Ink-Jet Head Unit, Sep. 24, 2004, Paragraphs 0019-0030 (Year: 2004).*

*Primary Examiner* — Lisa Solomon
(74) *Attorney, Agent, or Firm* — Xsensus LLP

(57) ABSTRACT

A liquid discharge head includes a head body configured to discharge a liquid, a head cover on the head body, a head cover covering at least a part of the head body, the head cover disposed outside the head body; a liquid supply port on an upper surface of the head cover, the liquid supply port configured to supply the liquid to the head body, an electrical connection on a side surface of the head cover. The head cover includes a protruding part protruding from the upper surface of the head cover, the protruding part is on a side end of the upper surface of the head cover adjacent to the side surface of the head cover on which the electrical connection is disposed, and the protruding part is higher than another part of the upper surface of the head cover with respect to a lower end surface of the head body.

14 Claims, 13 Drawing Sheets

(56) References Cited

U.S. PATENT DOCUMENTS

| | | | |
|---|---|---|---|
| 2019/0283414 | A1 | 9/2019 | Yoshida |
| 2019/0283416 | A1 | 9/2019 | Kinokuni |
| 2020/0086652 | A1 | 3/2020 | Iio et al. |
| 2020/0094573 | A1 | 3/2020 | Kohda et al. |
| 2020/0147961 | A1 | 5/2020 | Yoshida |
| 2020/0164644 | A1 | 5/2020 | Yoneta et al. |
| 2020/0171829 | A1 | 6/2020 | Kinokuni |
| 2020/0238696 | A1 | 7/2020 | Yoshida |
| 2020/0282740 | A1 | 9/2020 | Kohda et al. |
| 2020/0331262 | A1 | 10/2020 | Andou et al. |
| 2020/0346457 | A1 | 11/2020 | Iwata et al. |
| 2021/0001629 | A1 | 1/2021 | Yoshida |
| 2021/0001652 | A1 | 1/2021 | Kinokuni et al. |

* cited by examiner

COMPARATIVE EXAMPLE

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-127499, filed on Jul. 28, 2020, in the Japan Patent Office, the entire disclosures of which is hereby incorporated by reference herein.

BACKGROUND

Technical Field

Aspects of the present disclosure relate to a liquid discharge head, a liquid discharge device, and a liquid discharge apparatus.

Related Art

There is an image forming apparatus of liquid discharge recording type. The image forming apparatus uses a recording head including a liquid discharge head (inkjet head) that discharge a liquid such as an ink droplet. Examples of the image forming apparatus includes a printer, a facsimile, a copy device, a plotter, and a multifunction peripheral. As such an image forming apparatus, for example, an inkjet recording apparatus is known.

The liquid discharge head includes a head body and a cover. The head body discharge a liquid. The cover protects the head body. Such a configuration may cause problems of such as an ink adhering to a wiring of a connector and an ink entering inside the cover.

SUMMARY

In an aspect of this disclosure, a liquid discharge head includes a head body configured to discharge a liquid, a head cover on the head body, a head cover covering at least a part of the head body, the head cover disposed outside the head body; a liquid supply port on an upper surface of the head cover, the liquid supply port configured to supply the liquid to the head body, an electrical connection on a side surface of the head cover. The head cover includes a protruding part protruding from the upper surface of the head cover, the protruding part is on a side end of the upper surface of the head cover adjacent to the side surface of the head cover on which the electrical connection is disposed, and the protruding part is higher than another part of the upper surface of the head cover with respect to a lower end surface of the head body.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
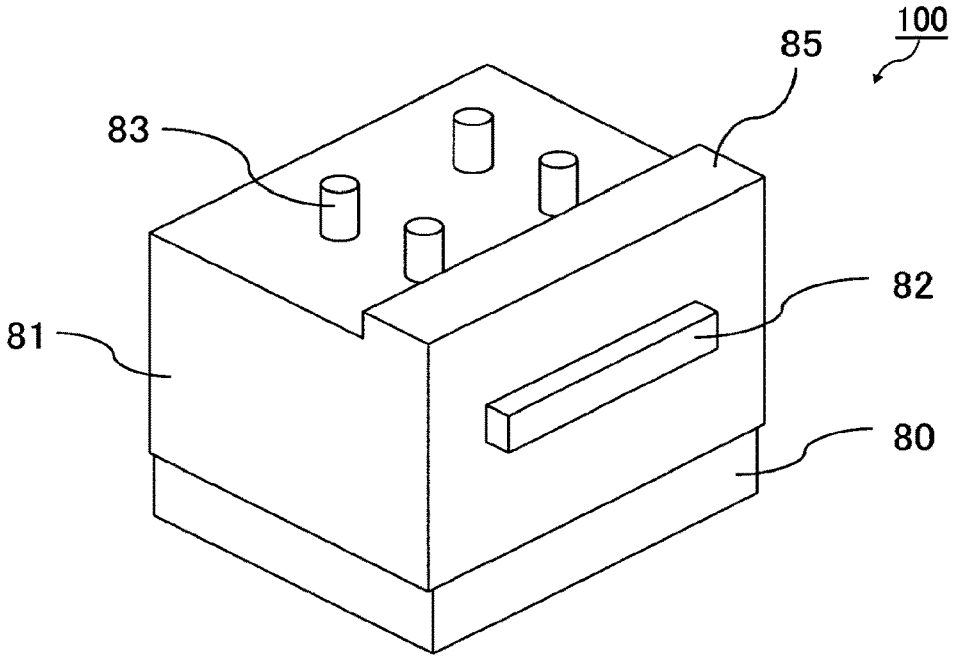
FIG. 1 is a schematic perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, a liquid discharge head, a liquid discharge device, and a liquid discharge apparatus according to a present embodiment is described with reference to the drawings. Note that the following embodiments are not limiting the present disclosure and any deletion, addition, modification, change, etc. can be made within a scope in which person skilled in the art can conceive including other embodiments, and any of which is included within the scope of the present disclosure as long as the effect and feature of the present disclosure are demonstrated.

First Embodiment

The liquid another aspect of the present invention, there is provided a liquid ejection head including: a head main body configured to eject liquid; a cover member provided outside the head main body; a liquid supply port provided on an upper surface of the cover member; and an electrical connection portion provided on a side surface of the cover member.

First, a comparative example of a liquid discharge head is described with reference to FIG. 9. Hereinafter, "the liquid discharge head" is simply referred to as a "head".

Figure 9:
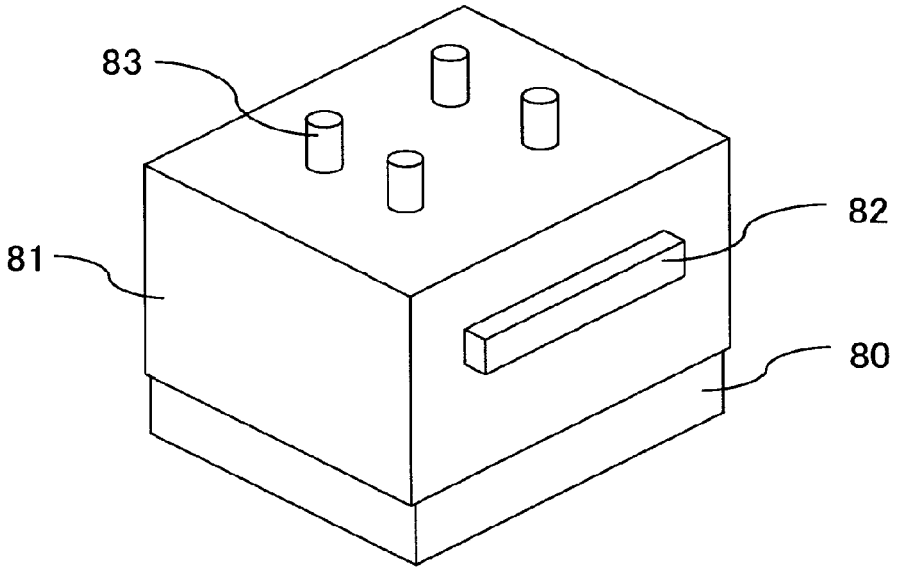
FIG. 9 is a schematic perspective view of the liquid discharge head according to a comparative example.

FIG. 9 is a perspective view of the head of the comparative example. The head includes a head body 80, a head cover 81, an ink supply port 83, and an electrical connection 82. The ink supply port 83 is provided on an upper surface of the head cover 81, and the electrical connection 82 is provided on a side surface of the head cover 81.

In this comparative example, ink droplets do not directly adhere to the electrical connection even if the ink droplets are dropped on the head cover. However, the ink droplets dripped on the upper surface of the head cover may flow to the electrical connection. The ink flowing to the electrical connection may cause connection failure.

FIG. 1 illustrates a liquid discharge head according to a first embodiment of the present disclosure.

FIG. 1 is a perspective view of a liquid discharge head according to the first embodiment of the present disclosure.

Similar to FIG. 9, the head 100 includes the head body 80, the head cover 81, the ink supply port 83, and the electrical connection 82.

The head body 80 discharges a liquid such as an ink. The head cover 81 is an example of a cover member and is provided on an exterior of the head body 80. The head cover 81 covers at least a part of the head body 80. In FIG. 1, the head cover 81 covers an upper part of the head body 80.

The ink supply port 83 is an example of a liquid supply port and is provided on the upper surface of the head cover 81. A number, an arrangement, and the like of the ink supply ports 83 are not limited to the number, the arrangement, and the like of the ink supply ports 83 illustrated in FIG. 1. The electrical connection 82 is provided (disposed) on the side surface of the head cover 81. The "electrical connection" may also be referred to as an "electrical connection part" or the like.

The head 100 according to the first embodiment includes a step 85 on the upper surface of the head cover 81, specifically, on a side end of the upper surface of the head cover 81 adjacent to the side surface of the head cover 81 on which the electrical connection 82 is provided (disposed) as illustrated in FIG. 1. Hereinafter, the "side end of the upper surface of the head cover 81 adjacent to the side surface of the head cover 81 on which the electrical connection 82 is provided" is simply referred to as a "side end of the head cover 81 on the electrical connection 82 side".

Thus, the head cover 81 includes a protruding part protruding from the upper surface of the head cover 81. In FIG. 1, the protruding part is the step 85. The protruding part is on a side end of the upper surface of the head cover 81 adjacent to the side surface of the head cover 81 on which the electrical connection 82 is provided. The protruding part is higher than other part of the upper surface of the head cover 81 with respect to a lower end surface (nozzle surface) of the head body.

An upper surface of the step 85 is higher than a portion other than the step 85 of the upper surface of the head cover 81 with respect to the lower end surface (nozzle surface) of the head body. The step 85 is formed along the side end of the head cover 81 serving as a side wall and a dam (barrier) on the upper surface of the head cover 81. The step 85 dams up the ink leaked from the ink supply port 83 not to flow to the side surface of the head cover 81 on which the electrical connection 82 is provided (disposed).

Thus, the step 85 of the head 100 can reduce an amount of the ink droplet flowing to the electrical connection 82 on the side surface of the head cover 81 to reduce occurrence of the contact failure due the ink droplet adhering to the electrical connection 82 even if the ink droplet is dripped onto the upper surface of the head cover 81 due to an unexpected situation or the like.

Further, the head 100 according to the first embodiment does not have to form the head cover 81 and a wiring cable as a single unit. Thus, the head 100 can reduce cost and allows a use of the wiring cable having an arbitrary length.

An object of the step 85 in the head 100 according to the first embodiment is to prevent the ink from flowing to the electrical connection 82 on the side surface of the head cover 81. Thus, the head 100 may include a protruding part other than the step 85 in FIG. 1 to prevent the ink from flowing to the electrical connection 82. For example, the head 100 may include a slope instead of the step 85 as the protruding part.

One end of the slope adjacent to the side surface of the head cover 81 on which the electrical connection is formed may be higher than other part of the upper surface of the head cover 81 with respect to the lower end surface (nozzle surface) of the head body. Such the protruding part as a high portion may be referred to as a dam or a side wall. The step 85 is an example of a dam. The head 100 includes the step 85 as the dam on the side end of the head cover 81 on the electrical connection 82 side. Thus, the step 85 can prevent the ink to flow to the side surface of the head cover 81.

In the head 100 according to the first embodiment, it is described that the side end of the head cover 81 on the electrical connection 82 side is higher than a portion on the upper surface of the head cover 81 other than the side end of the head cover 81 on the electrical connection 82 side with respect to the lower end surface (nozzle surface) of the head body.

However, the above configuration can also be expressed in another way. For example, it may be expressed that the side end of the head cover 81 on the electrical connection 82 side protrudes in a direction opposite to a liquid discharge direction in which the liquid is discharged on the upper surface of the head cover 81. Further, it may be expressed that a portion other than the side end of the head cover 81 on the electrical connection 82 side is lower than the side end of the head cover 81 on the electrical connection 82 side on the upper surface of the head cover 81.

The height of the step 85 may be appropriately changed as long as the step 85 can reduce an amount of ink flow to the electrical connection 82. The step 85 may be higher than other portions of the upper surface of the head cover 81 with respect to the lower end surface (nozzle surface) of the head body 80, for example. The other portions are appropriately changed.

For example, a portion in which the ink supply port 83 is provided, a central portion on the upper surface of the head cover 81, and the like may be appropriately changed. In the head 100 according to the first embodiment, the head 100 includes the step 85 on the side end of the head cover 81 on the electrical connection 82 side on the upper surface of the head cover 81. However, the step 85 may be provided at an end of the upper surface of the head cover 81. The step 85 may also be provided at a distance from the side end of the upper surface of the head cover 81.

The head 100 according to the first embodiment includes the ink supply port 83 in a portion of the head cover 81 other than the side surface on which the electrical connection 82 is disposed (provided). In the first embodiment, the ink supply port 83 is provided at a position lower than the side end of the head cover 81 on the upper surface of the head cover 81.

Thus, even if ink leaks from a tube or the like inserted into the ink supply port 83, or even if ink drips when the tube or the like is inserted into or removed from the ink supply port 83, the step 85 prevents the ink from flowing to the electrical connection 82 on the side surface of the head cover 81. Thus, the step 85 can reduce or prevent the ink from flowing to the side surface of the head cover 81 on which the electrical connection 82 is provided, and the step 85 thus can prevent the occurrence of a connection failure.

The head 100 in the first embodiment preferably includes a protector 92 (See FIG. 2) on the electrical connection 82 to protect a terminal surface 82*a* of the electrical connection 82 in a state in which a connector 91 is connected to the electrical connection 82. The protector 92 protects the terminal surface 82*a* of the electrical connection 82 to prevent a head failure due to ink adhered to the electrical connection 82 even when a floating ink such as mist is generated or ink drips onto the side end of the head cover 81 on the electrical connection 82 side.

The protector 92 may be appropriately selected, and an elastic member may be used, for example. For example, the protector 92 may be an elastic member covering a terminal surface of the electrical connection 82.

Figure 2:
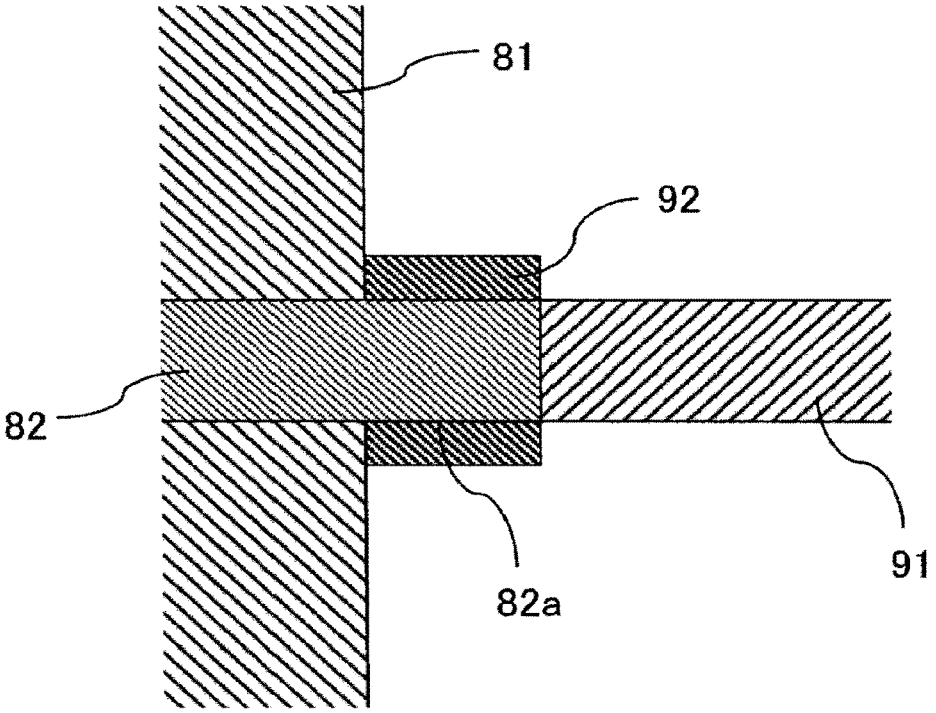
FIG. 2 is a schematic cross-sectional view of the liquid discharge head according to the first embodiment of the present disclosure.

FIG. 2 illustrates an example of a configuration of the protector 92.

FIG. 2 is a cross-sectional view of a periphery of an opening in the first embodiment.

FIG. 2 illustrates a state in which the connector 91 is connected to the electrical connection 82. As illustrated in FIG. 2, the protector 92 protects the terminal surface 82*a* of the electrical connection 82. A shape, a size, and the like of the protector 92 are not limited to the shape, the size, and the like as illustrated in FIGS. 1 and 2. The shape, size and the like of the protector 92 may be appropriately changed.

Second Embodiment

The head 100 according to a second embodiment of the present disclosure is described below. Hereinafter, descriptions of the same items as those in the above embodiments will be appropriately omitted. In addition, the preferable configuration in the above-described embodiment can also be applied to the present embodiment.

In the head 100 according to the second embodiment includes the step 85 and a step 86 on the upper surface of the head cover 81. Specifically, the step 86 is formed on a side end of the head cover 81 different from the side end on which the step 85 is formed, that is, the side end adjacent to the side surface of the head cover 81 on which the electrical connection 82 is provided.

Figure 3:
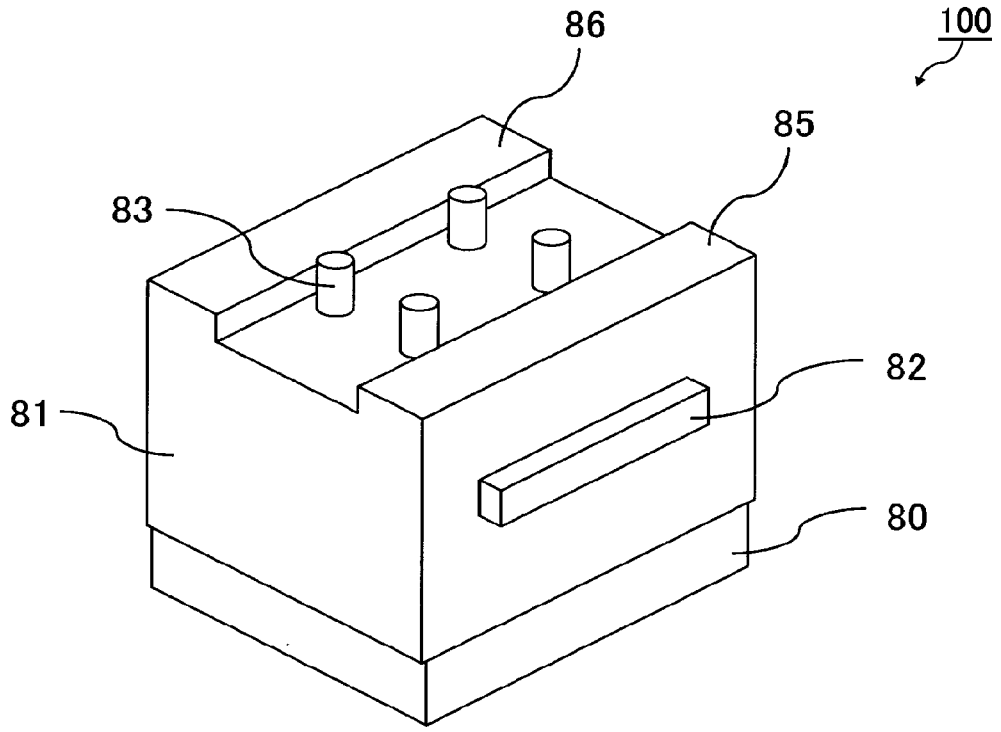
FIG. 3 is a schematic perspective view of the liquid discharge head according to a second embodiment of the present disclosure.

FIG. 3 is a perspective view of the head 100 according to the second embodiment of the present disclosure.

FIG. 3 illustrates an example of the second embodiment and is the perspective view similar to FIG. 1.

In an example illustrated in FIG. 3, the head 100 includes the step 86 on the upper surface of the head cover 81. The step 86 is formed on the side end of the head cover 81 different from the side end of the head cover 81 on the electrical connection 82 side. Thus, the head 100 according to the second embodiment can guide the liquid dripped on the upper surface of the head cover 81 in a desired direction so that the head 100 can prevent the ink from contacting the electrical connection 82.

In the head 100 according to the second embodiment includes the step 86 opposite to the step 85 at a side end of the head cover 81 on the electrical connection 82 side. However, a step may be provided on other side ends of the head cover 81 (left end side and right end side in FIG. 3, for example). Further, steps may be provided on three sides on the upper surface of the head cover 81. The head 100 may include the steps such that a top view of the steps on the upper surface of the head cover 81 has an L-shape or a U-shape when the head cover 81 is viewed from above, for example.

In the head 100 according to the second embodiment, a step is used as a device to prevent the ink from flowing to the side surface of the head cover 81. However, the dam may be used to prevent the ink from flowing to the side surface of the head cover 81 instead of the steps 85 and 86 as in the above second embodiment.

Third Embodiment

The head 100 according to a second embodiment of the present disclosure is described below. Hereinafter, descriptions of the same items as those in the above embodiments will be appropriately omitted. In addition, the preferable configuration in the above-described embodiment can also be applied to the present embodiment.

The head 100 in the third embodiment includes a step 87 around an entire periphery of the upper surface of the head cover 81. The step 87 surrounds the ink supply port 83.

Figure 4:
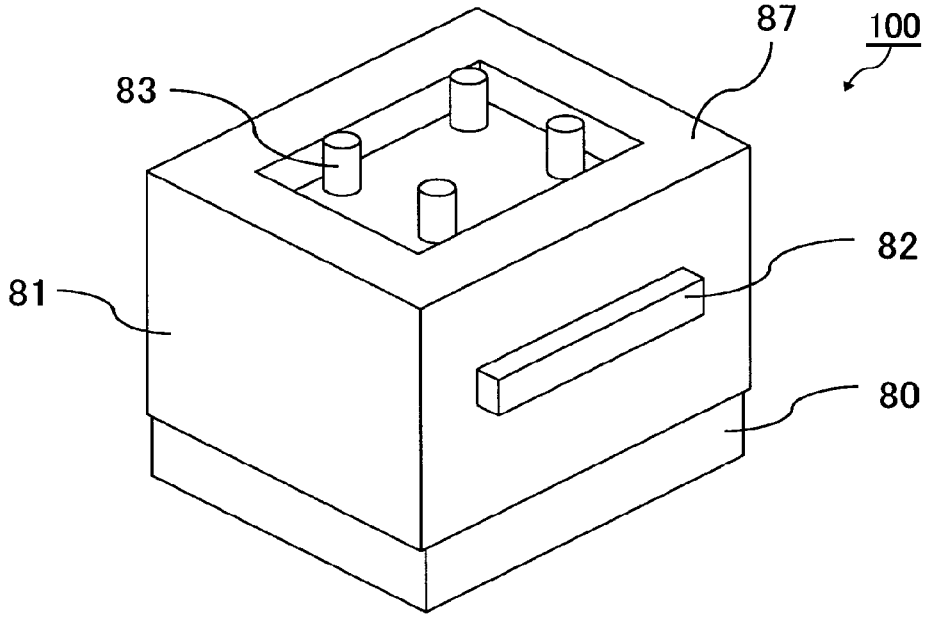
FIG. 4 is a schematic perspective view of the liquid discharge head according to a third embodiment of the present disclosure.

FIG. 4 is a perspective view of the head 100 according to the third embodiment of the present disclosure. As illustrated in FIG. 4, the head 100 in the third embodiment includes the step 87 on the entire periphery of the upper surface of the head cover 81. That is, the step 87 is formed around all the side ends (four sides) of the upper surface of the head cover 81. Thus, even if the ink drips on the upper surface of the head cover 81, the ink stays on the upper surface of the head cover 81. Thus, the step 87 can prevent the ink from flowing down on the side surfaces from the upper surface of the head cover 81.

In the head 100 according to the third embodiment, the step 87 is used as a device to prevent the ink from flowing to the side surface of the head cover 81. However, the dam may be used to prevent the ink from flowing to the side surface of the head cover 81 instead of the steps 85 and 86 as in the above second embodiment.

Fourth Embodiment

The head 100 according to a second embodiment of the present disclosure is described below. Hereinafter, descriptions of the same items as those in the above embodiments will be appropriately omitted. In addition, the preferable configuration in the above-described embodiment can also be applied to the present embodiment.

The head 100 according to the fourth embodiment includes an opening 88 on the side surface of the head cover 81. The electrical connection 82 is disposed inside in the head cover 81 at a position facing the opening 88 of the head cover 81. The opening 88 allows the connector 91 to be connected to the electrical connection 82 in the opening 88. Thus, the head cover 81 includes the opening 88 through which the connector 91 is connectable to the electrical connection 82.

Figure 5:
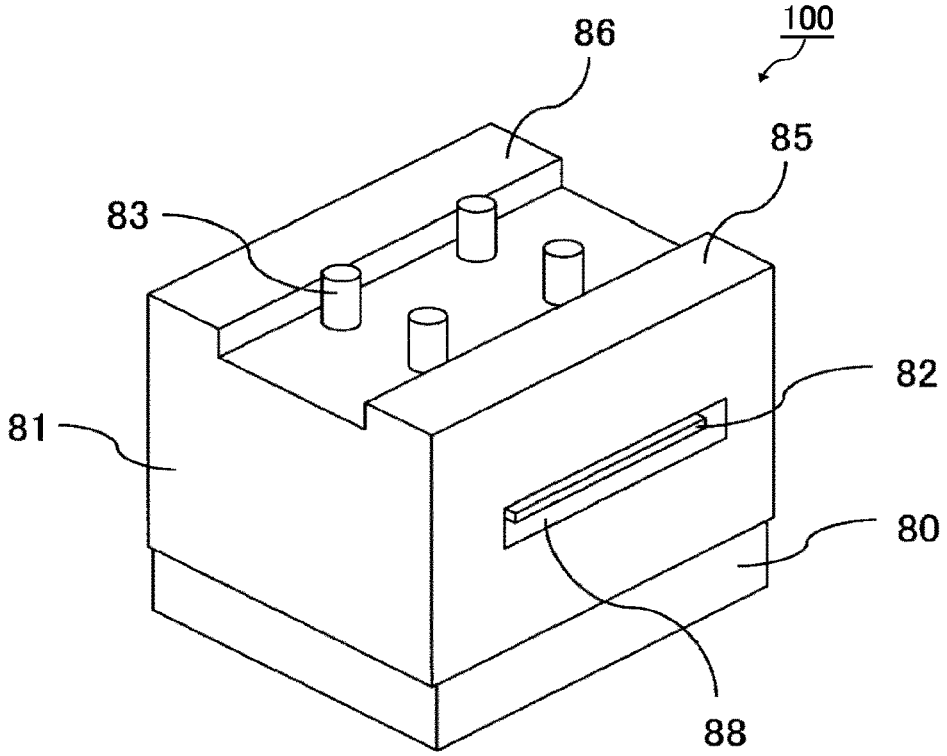
FIG. 5 is a schematic perspective view of the liquid discharge head according to a fourth embodiment of the present disclosure.

FIG. 5 is a perspective view of the head 100 according to the fourth embodiment of the present disclosure. As illustrated in FIG. 5, the head cover 81 of the head 100 in the fourth embodiment includes the opening 88. The connector 91 is connected to the electrical connection 82 through the opening 88. The electrical connection 82 is disposed inside the opening 88 of the head cover 81 (disposed inside the head cover 81). Thus, even if ink drips from the upper surface of the head cover 81 to the side surface of the head cover 81, the head 100 can prevent the ink from contacting the electrical connection 82.

The head 100 according to the fourth embodiment illustrated in FIG. 5 includes the steps 85 and 86 as in the head 100 according to the second embodiment as illustrated in FIG. 3. Further, as in the above-described embodiment, the steps 85 and 86 may be used as the dam.

The head 100 according to the fourth embodiment preferably includes a sealing member 93 to close (seal) the opening 88. That is, the sealing member 93 in the present example seals (closes) a gap between the connector 91 and a portion of the head cover 81 around the opening 88 after the connector 91 is connected to the electrical connection 82 via the opening 88 as illustrated in FIG. 6.

Thus, even when floating ink such as mist is generated, or even when ink drips onto the side surface of the head cover 81 on which the electrical connection 82 is provided, the sealing member 93 can prevent the ink from contacting the electrical connection 82 that causes the head failure.

A material of the sealing member 93 can be appropriately selected. For example, an elastic member may be used as the material of the sealing member 93. For example, a sealing ring such as an O-ring made of rubber may be used as the sealing member 93. Further, a gasket or the like may be used as the sealing member 93, for example.

Figure 6:
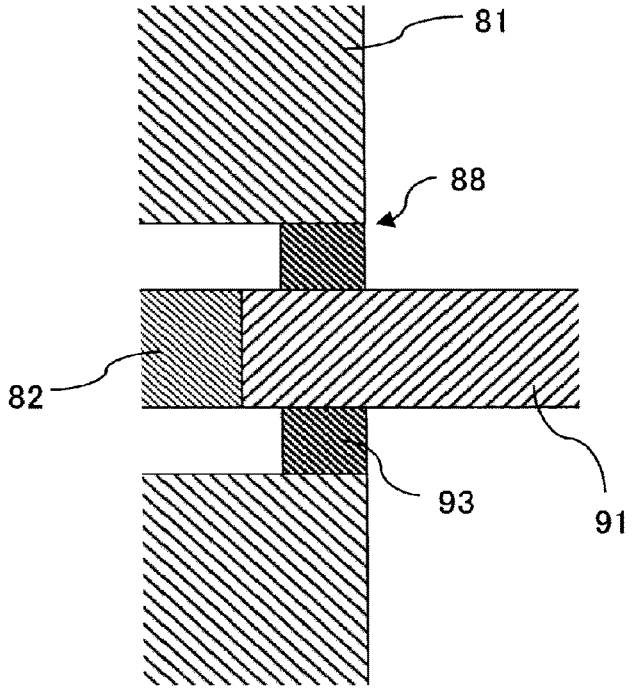
FIG. 6 is a schematic cross-sectional view of the liquid discharge head according to the fourth embodiment of the present disclosure.

FIG. 6 illustrates an example of a configuration of the head 100 when the sealing member 93 is used to close (seal) the opening 88.

FIG. 6 is a cross-sectional view of the periphery of the opening 88 in the fourth embodiment.

FIG. 6 illustrates a state in which the connector 91 is connected to the electrical connection 82. As illustrated in the FIG. 6, a gap between the connector 91 and a portion of the head cover 81 around the opening 88 is closed (sealed) by the sealing member 93. A shape, a size, and the like of the sealing member 93 are not limited to the shape, the size, and the like of the sealing member 93 as illustrated in the drawings and can be appropriately changed.

An example of a configuration of the head 100 including the sealing member 93 is described below in detail using FIGS. 7A and 7B.

Figure 7A:
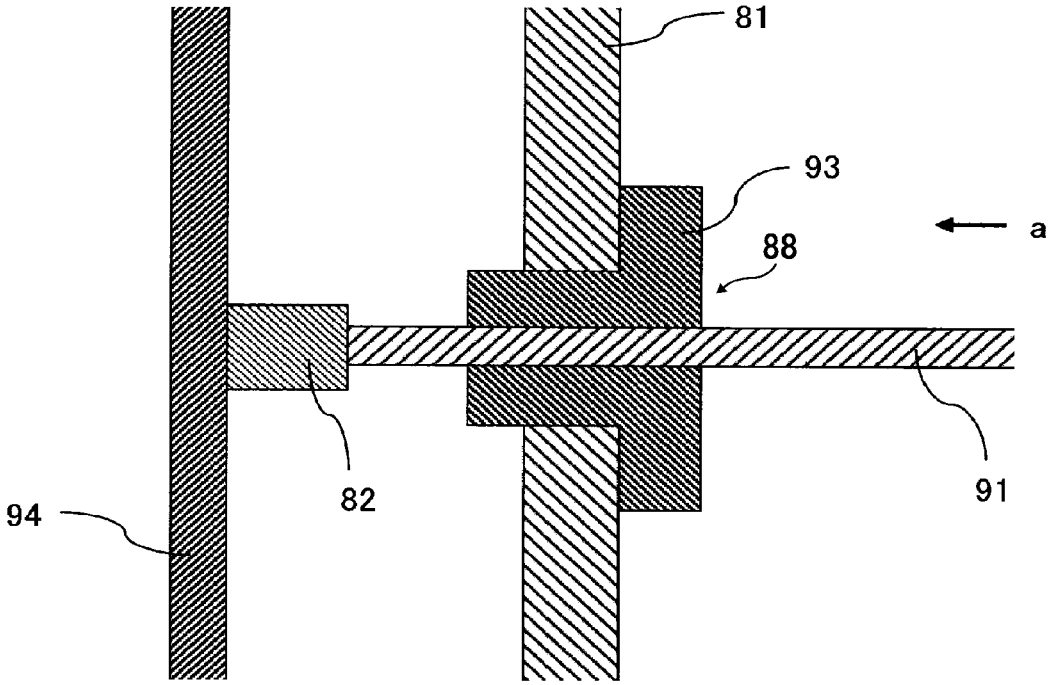
FIG. 7A is a schematic cross-sectional view and FIG. 7B is a schematic front view of the liquid discharge head according to the fourth embodiment of the present disclosure.

FIG. 7A is a cross-sectional view of a part of the head 100 in a periphery of the opening 88 in the fourth embodiment.

FIG. 7A illustrates a state in which the connector 91 is connected to the electrical connection 82. In this example in FIG. 7A, the head cover 81 includes the opening 88. The electrical connection 82 is disposed inside the head cover 81, and the electrical connection 82 is provided on the substrate 94. The electrical connection 82 faces the opening 88.

In this example illustrated in FIG. 7A, a rubber packing can be used as the sealing member 93, for example. A Flexible Flat Cable (FFC) can be used as the connector 91, for example.

To connect the connector 91 to the electrical connection 82 as illustrated in FIG. 7A, the connector 91 is inserted into the sealing member 93 first, and then the connector 91 is inserted into the electrical connection 82. Then, the sealing member 93 is fitted into the opening 88 of the head cover 81. Thus, the connector 91 can be connected to the electrical connection 82 while the opening 88 is sealed with the sealing member 93 as illustrated in FIG. 7A.

Figure 7B:
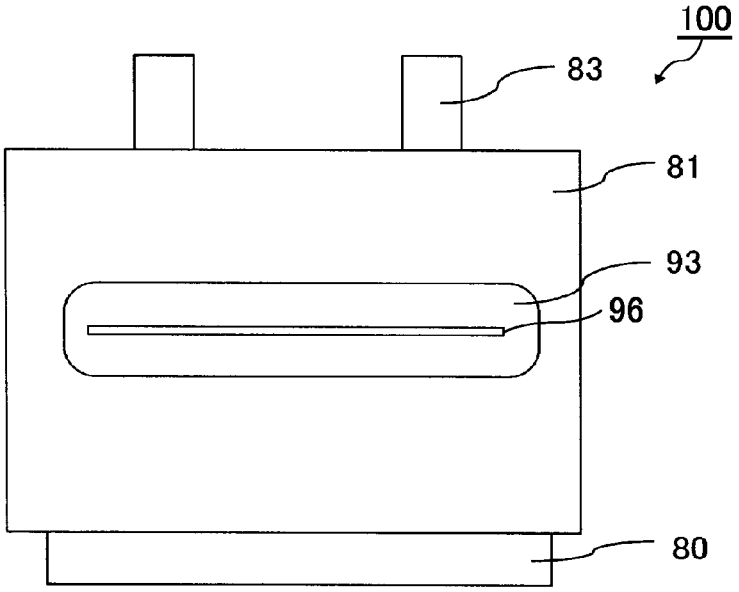

FIG. 7B is a front view (or a side view) viewed from a direction "a" as indicated in FIG. 7A.

FIG. 7B illustrates a state before the connector 91 is connected to the electrical connection 82. For example, the sealing member 93 includes a slit 96 for inserting the connector 91. After the connector 91 is connected to the electrical connection 82 via the slit 96, the sealing member 93 is fitted into the opening 88 of the head cover 81.

Fifth Embodiment

The head 100 according to a second embodiment of the present disclosure is described below. Hereinafter, descriptions of the same items as those in the above embodiments will be appropriately omitted. In addition, the preferable configuration in the above-described embodiment can also be applied to the present embodiment.

Figure 8:
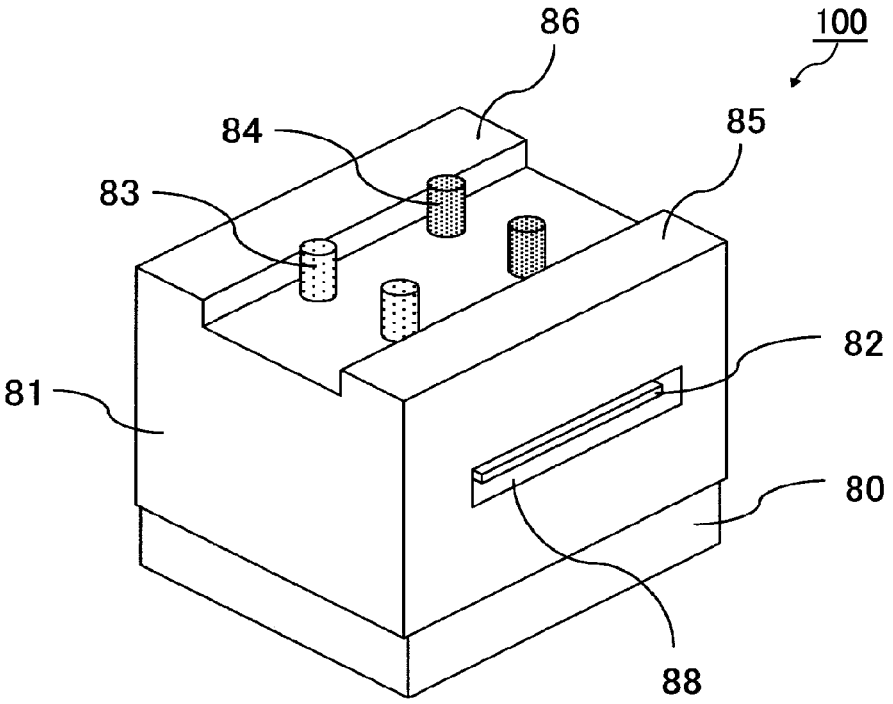
FIG. 8 is a schematic perspective view of the liquid discharge head according to a fifth embodiment of the present disclosure.

The head 100 according to the fifth embodiment is a circulation-type head. The head 100 includes an ink discharge port 84 on an upper surface of a head cover 81 as illustrated in FIG. 8. The ink discharge port serves as a liquid discharge port.

FIG. 8 is a perspective view of the head 100 according to the fifth embodiment of the present disclosure. As illustrated in the FIG. 8, the head 100 includes the ink supply port 83 and the ink discharge port 84 on the upper surface of the head cover 81.

The ink discharge port 84 is an example of a liquid discharge port. A number, an arrangement, and the like of the ink supply ports 83 and the ink discharge port are not limited to the number, the arrangement, and the like of the ink supply ports 83 and the ink discharge port 84 as illustrated in FIGS. 1 to 8.

As described above, the head 100 according to the fifth embodiment can be a circulation-type head as illustrated in FIG. 8 as well as a non-circulation-type head. The same effect as described in the above-described embodiments can be obtained in the circulation-type head as illustrated in FIG. 8.

The circulation-type head has a higher risk of ink leakage than the non-circulation-type head because a higher pressure is applied to an ink supply system of the circulation-type head. Even in such the circulation-type head, the steps 85 and 86 can prevent the ink from dripping to the electrical connection 82 to prevent the head failure when the ink drips on the upper surface of the head cover 81.

Although FIG. 8 illustrates an example in which the head cover 81 includes the opening 88, the fifth embodiment is not limited to the example as illustrated in FIG. 8. The head cover 81 may not include the opening 88. Although the head 100 includes the step 85 and the step 86 in the example illustrated in FIG. 8, the head 100 according to the fifth embodiment is not limited to the head 100 as illustrated in FIG. 8. Further, as in the above-described embodiment, the steps 85 and 86 may be used as the dam.

[Basic Configuration of Head, Liquid Discharge Device, and Liquid Discharge Apparatus]

A basic configuration of the head 100 according to the present embodiment is described below.

Figure 10:
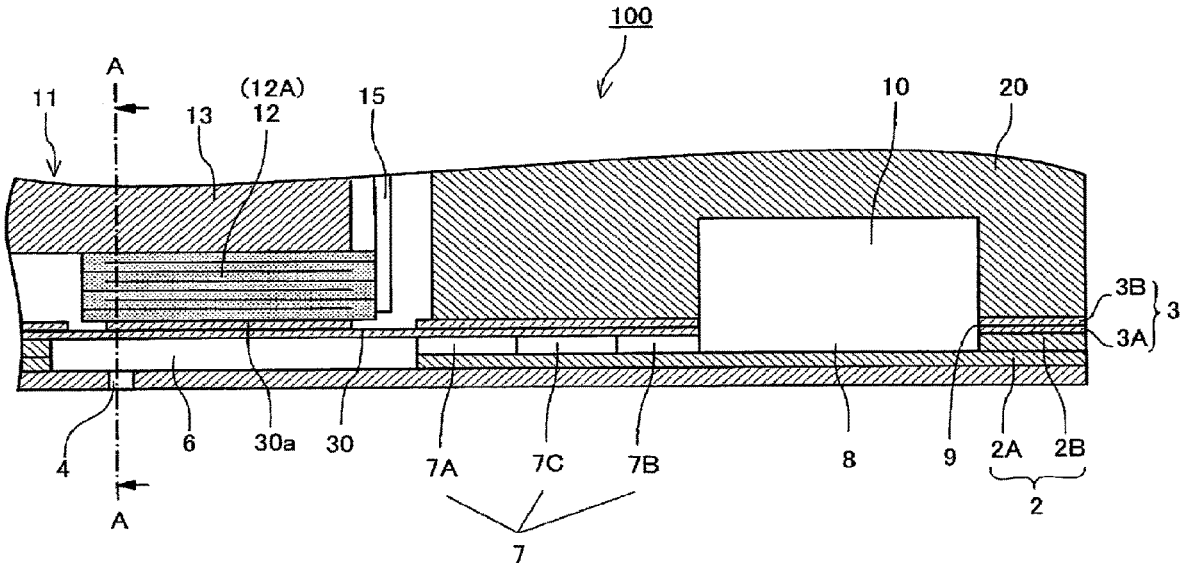
FIG. 10 is a schematic cross-sectional view of the liquid discharge head according to another embodiment of the present disclosure.

FIG. 10 is a cross-sectional view of the head 100 along a direction (pressure-chamber longitudinal direction) orthogonal to a nozzle array direction of the head 100 according to an embodiment of the present disclosure.

Figure 11:
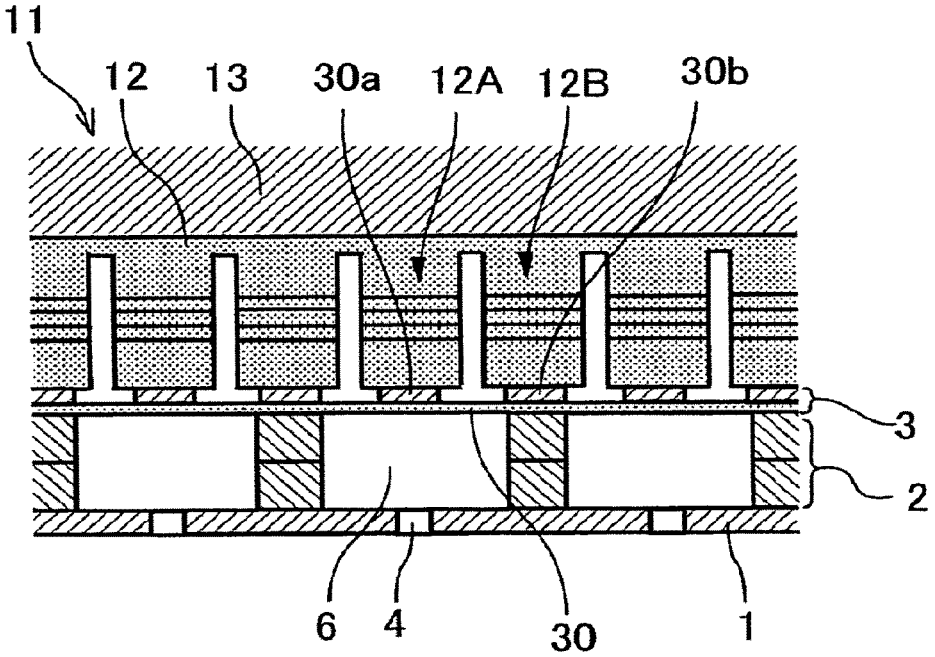
FIG. 11 is another schematic cross-sectional view of the liquid discharge head according to another embodiment of the present disclosure.

FIG. 11 is a schematic cross-sectional view of a portion of the head 100 of FIG. along the nozzle array direction.

The head 100 according to the present embodiment includes a nozzle plate 1, a channel plate 2 as an individual channel member, and a diaphragm 3 as a wall that are laminated one on another and bonded to each other. The head 100 further includes a piezoelectric actuator 11 to displace vibration regions 30 (vibration plate) of the diaphragm 3 and a common channel member 20 also serving as a frame of the head 100.

The nozzle plate 1 includes a plurality of nozzles 4 to discharge a liquid. The nozzle plate 1 has a nozzle surface in which the plurality of nozzles 4 are formed. The nozzle surface is disposed at a lower end of the head body 80. Thus, the nozzle surface serves as the lower end surface of the head body 80.

The channel plate 2 forms a plurality of pressure chambers 6 communicating with the plurality of nozzles 4, a plurality of individual supply channels 7 that are individual channels communicating with the respective pressure chambers 6, and a plurality of intermediate supply channels 8 that are liquid inlets each communicating with one or the plurality of individual supply channels 7 (e.g., one individual supply channel in the present embodiment). The channel plate 2 includes a first layer of plate member 2A and a second layer of plate member 2B.

The diaphragm 3 includes a plurality of deformable vibration region 30 (vibration plate) that forms walls of pressure chambers 6 of the channel plate 2. The diaphragm 3 has a two-layer structure, but not limited to two layers. The diaphragm 3 includes a first layer 3A forming a thin portion and a second layer 3B forming a thick portion from the channel plate 2.

The displaceable vibration region 30 is formed in a portion corresponding to the pressure chamber 6 in the first layer 3A that is a thin portion. In the vibration region 30, convex portions 30*a* and 30*b* are formed as thick portions joined to the piezoelectric actuators 11 in the second layer 3B.

The piezoelectric actuator 11 includes electromechanical transducer element as a driving device (actuator device or pressure generator) to deform the vibration regions of the diaphragm 3. The piezoelectric actuator 11 is disposed at a first side of the diaphragm 3 opposite a second side of the diaphragm 3 facing the pressure chambers 6.

The piezoelectric actuator 11 includes a piezoelectric member bonded on a base 13. The piezoelectric member is groove-processed by half cut dicing so that each piezoelectric element 12 includes a desired number of pillar-shaped piezoelectric elements 12 that are arranged in certain intervals to have a comb shape in the nozzle array direction. The piezoelectric element 12 is joined to the convex portion 30*a* that is a thick portion formed on the vibration region 30 of the diaphragm 3.

The piezoelectric element 12 includes piezoelectric layers and internal electrodes alternately laminated on each other. Each internal electrode is led out to an end surface and connected to an external electrode (end surface electrode). The external electrode is connected with a flexible wiring member 15.

The piezoelectric element 12 includes a first piezoelectric element 12A serves to deform the diaphragm 3 and a second piezoelectric element 12B serves as a support to support the diaphragm 3.

The common channel member 20 forms a common supply channel 10 communicated with the plurality of pressure chambers 6. The common supply channel communicates with the intermediate supply channel 8 serving as a liquid inlet through the opening 9 formed in the diaphragm 3 and further communicates with the individual supply channel 7 through the intermediate supply channel 8.

In the head 100, for example, the voltage to be applied to the piezoelectric element 12 is lowered from a reference potential (intermediate potential) so that the piezoelectric element 12 contracts to pull the vibration region 30 of the diaphragm 3 to increase a volume of the pressure chamber 6. As a result, liquid flows into the pressure chamber 6.

When the voltage applied to the piezoelectric element 12 is raised, the piezoelectric element 12 expands in a direction of lamination of the piezoelectric element 12. The vibration region 30 of the diaphragm 3 deforms in a direction toward the nozzle 4 and contracts the volume of the pressure chambers 6. As a result, the liquid in the pressure chambers 6 is squeezed out of the nozzle 4 so that the liquid is discharged from the nozzle 4.

Figure 12:
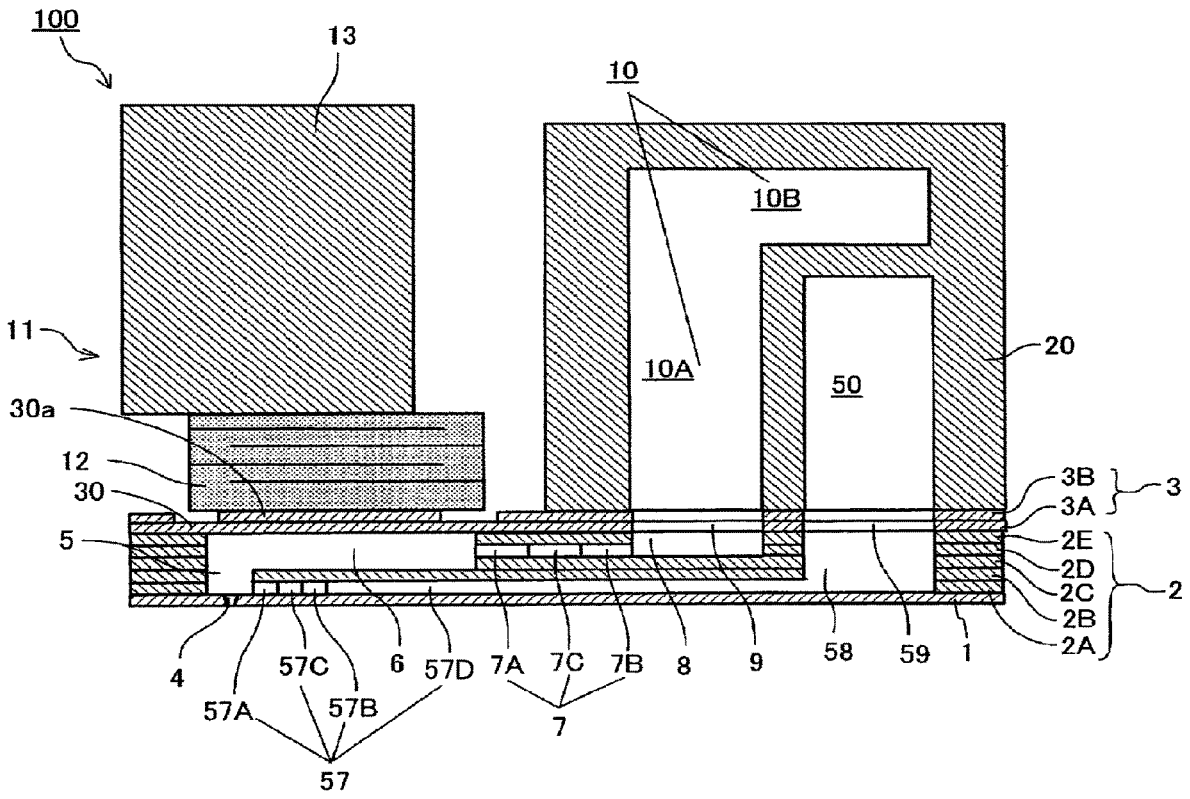
FIG. 12 is a schematic cross-sectional view of the liquid discharge head according to still another embodiment of the present disclosure.

FIG. 12 is a cross-sectional view of the head 100 according to another embodiment, along a direction (pressure-chamber longitudinal direction) orthogonal to the nozzle array direction of the head 100. The head 100 according to the present embodiment is a circulation-type liquid discharge head.

The head 100 includes the nozzle plate 1, the channel plate 2, and the diaphragm 3 as a wall laminated and bonded with each other. The head 100 further includes a piezoelectric actuator 11 to displace vibration regions 30 (vibration plate) of the diaphragm 3 and a common channel member 20 also serving as a frame of the head 100.

The channel plate 2 includes pressure chambers 6, individual supply channels 7, and an intermediate supply channel 8, for example. The pressure chambers 6 respectively communicate with the nozzles 4 via the nozzle communication channels 5. The individual supply channels 7 also serve as fluid restrictors respectively communicating with the pressure chambers 6. The intermediate supply channel 8 serves as one or more liquid inlet communicating with two or more individual supply channels 7.

Similarly to the above-described embodiments, the individual supply channel 7 includes two channel portions, i.e., a first channel portion 7A and a second channel portion 7B having a higher fluid resistance than the pressure chamber 6, and a third channel portion 7C disposed between the first channel portion 7A and the second channel portion 7B and having a lower fluid resistance than each of the first channel portion 7A and the second channel portion 7B.

The channel plate 2 has a configuration in which a plurality of plate members 2A to 2E are stacked one on another. However, the configuration of the channel plate 2 is not limited to a configuration as described above.

As illustrated in FIG. 12, the channel plate 2 forms a plurality of individual collection channels 57 and an intermediate collection channel 58. The plurality of individual collection channels 57 are formed along the surface direction of the channel plate 2 that respectively communicate with the plurality of pressure chambers 6 via the nozzle communication channels 5. The intermediate collection channel 58 serves as one or a plurality of liquid inlets that communicate with two or more individual collection channels 57.

The individual collection channel 57 includes two channel portions, i.e., a first channel portion 57A and a second channel portion 57B having a higher fluid resistance than the pressure chamber 6, and a third channel portion 57C disposed between the first channel portion 57A and the second channel portion 57B and having a lower fluid resistance than each of the first channel portion 57A and the second channel portion 57B. In the individual collection channel 57, a channel portion 57D downstream from the second channel portion 57B in the direction of circulation of the liquid has the same channel width as the third channel portion 57C.

The common channel member 20 forms a common supply channel 10 and a common collection channel 50. In the present embodiment, the common supply channel 10 includes a channel portion 10A arranged side-by-side with the common collection channel 50 in the nozzle array direction and a channel portion 10B that is not arranged side-by-side with the common collection channel 50.

The common supply channel 10 communicates with the intermediate supply channel 8 serving as a liquid inlet through the opening 9 formed in the diaphragm 3 and further communicates with the individual supply channel 7 through the intermediate supply channel 8. The common collection channel 50 communicates with the intermediate collection channel 58 serving as the liquid outlet through an opening 59 formed in the diaphragm 3 and further communicates with the individual collection channel 57 through the intermediate collection channel 58.

The common supply channel 10 communicates with, for example, an ink supply port 83, and the common collection channel 50 communicates with, for example, an ink discharge port 84.

A layer structure of the diaphragm 3 and a structure of the piezoelectric actuator 11 are the same as the layer structure of the diaphragm 3 and the structure of the piezoelectric actuator 11 in the above-described embodiment.

In this head 100 also, as similarly with the above embodiments, when the voltage applied to the piezoelectric element 12 is raised, the piezoelectric element 12 expands in a direction of lamination of the piezoelectric element 12. The vibration region 30 of the diaphragm 3 deforms in a direction toward the nozzle 4 and contracts the volume of the pressure chambers 6. As a result, the liquid in the pressure chambers 6 is squeezed out of the nozzle 4 so that the liquid is discharged from the nozzle 4.

The liquid not discharged from the nozzle 4 passes by the nozzle 4, is collected from the individual collection channel 57 to the common collection channel 50, and is supplied again from the common collection channel 50 to the common supply channel through an external circulation passage. Even when the liquid is not discharged from the nozzle 4, the liquid flows and circulates from the common supply channel 10 to the common collection channel 50 through the pressure chamber 6 and is again supplied to the common supply channel 10 through the external circulation passage.

Accordingly, also in the head 100 according to the present embodiment, the pressure fluctuation accompanying liquid discharge can be attenuated with a simple configuration, thus restraining propagation of the pressure fluctuation to the common supply channel 10 and the common collection channel 50.

Next, a liquid discharge device and a liquid discharge apparatus according to the present embodiment is described below with reference to FIGS. 13 to 19.

The liquid discharge device according to an embodiment of the present disclosure includes the head 100 according to the above-described embodiments of the present disclosure. Further, the liquid discharge device according to the present embodiment includes the head 100 and at least one of: a head tank that stores liquid to be supplied to the head 100, a carriage on which the head 100 is mounted, a supply unit that supplies liquid to the head 100; a maintenance unit that maintains and recover a discharge function of the head 100; and a main scan moving unit to move the head 100 in the main scanning direction to form a single unit.

The liquid discharge apparatus according to the present embodiment includes the head 100 or the liquid discharge device according to the present embodiment.

The liquid discharge apparatus according to an embodiment of the present disclosure is described in detail below with reference to FIGS. 13 and 14.

Figure 13:
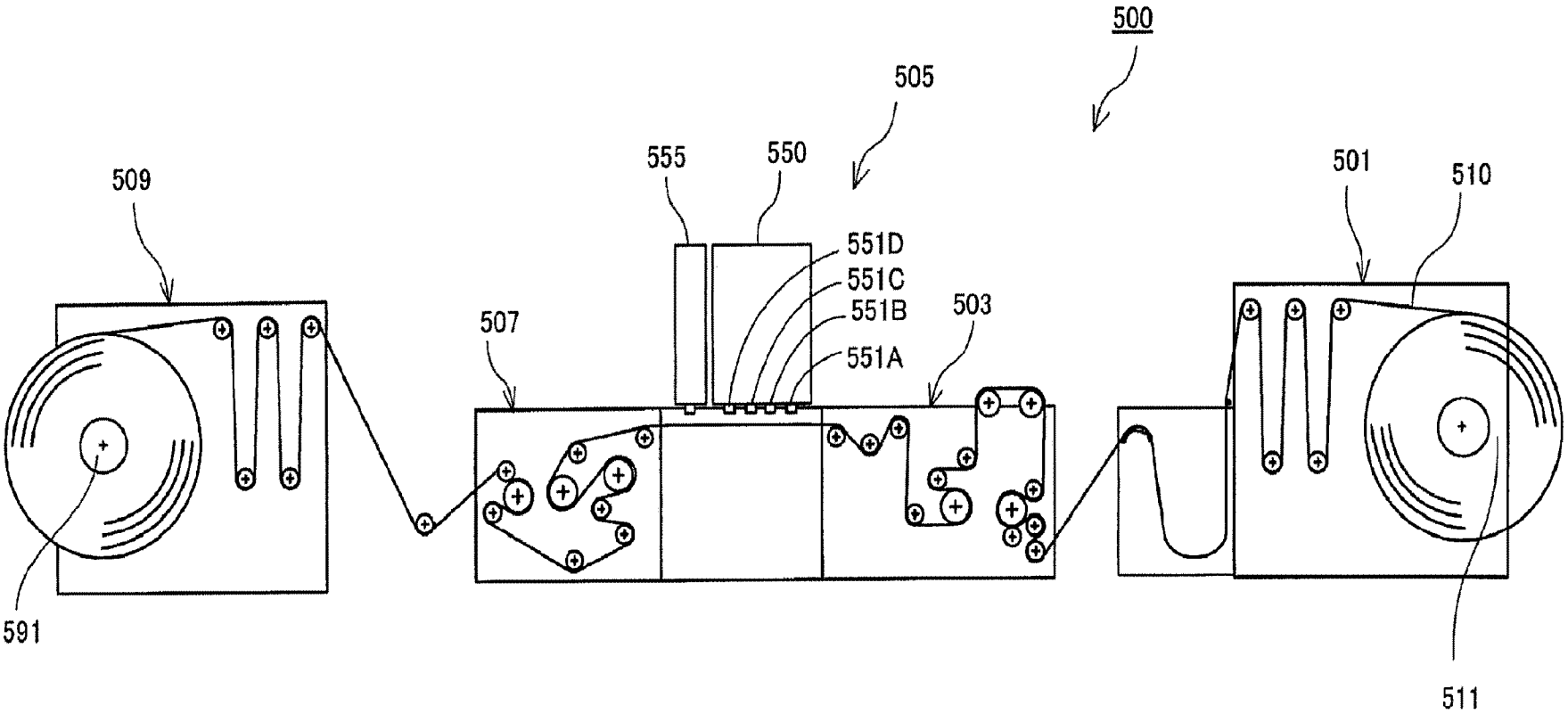
FIG. 13 is a schematic side view of a liquid discharge apparatus according to an embodiment of the present disclosure.

FIG. 13 is a side view of the liquid discharge apparatus as the liquid discharge apparatus according to the seventh embodiment of the present disclosure.

Figure 14:
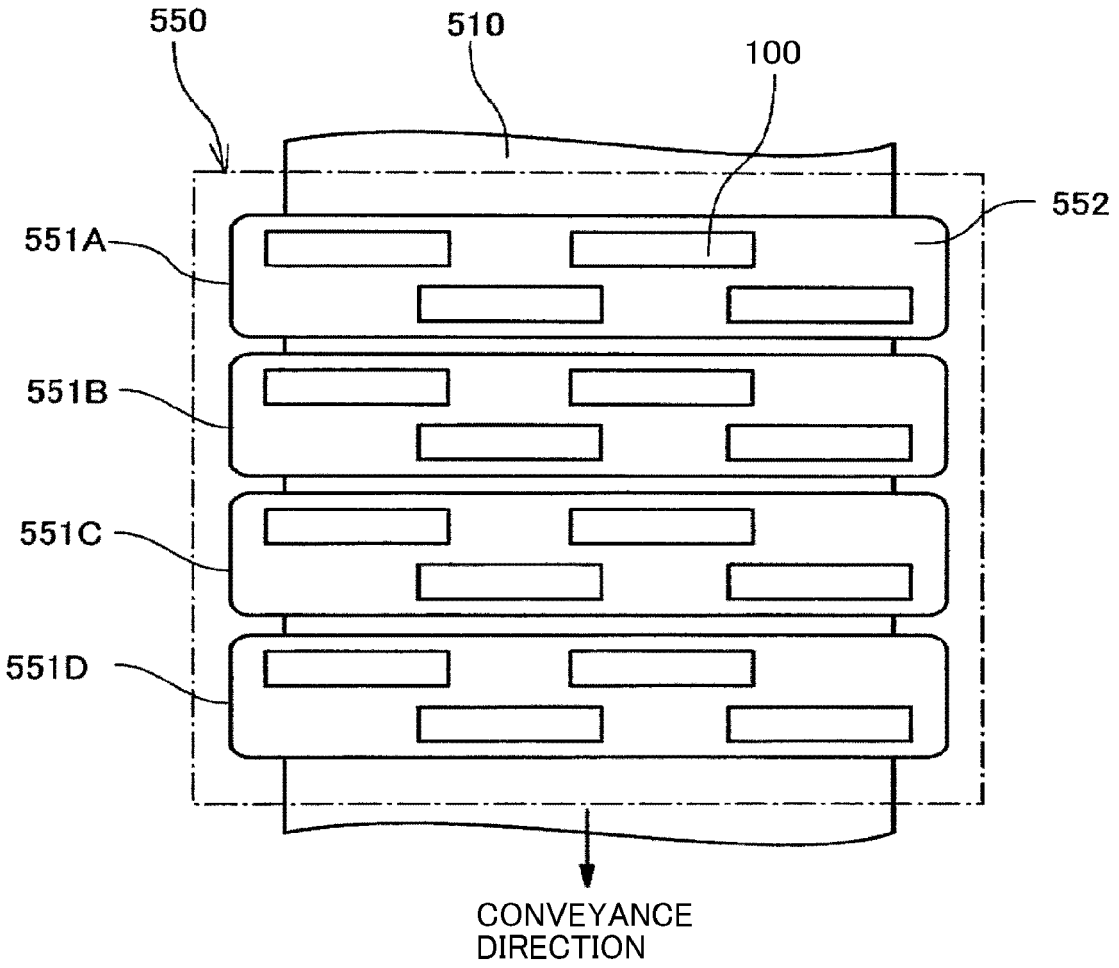
FIG. 14 is a schematic plan view of an example of a head unit of the liquid discharge apparatus of FIG. 13.

FIG. 14 is a plan view of a head unit of the liquid discharge apparatus of FIG. 13 according to the present embodiment.

A printer 500 serving as the liquid discharge apparatus includes a feeder 501, a guide conveyor 503, a printing device 505, a dryer 507, and an ejector 509. The feeder 501 feeds a continuous medium 510 such as a rolled sheet. The guide conveyor 503 guides and conveys the continuous medium 510 such as a continuous paper or a rolled sheet, fed from the feeder 501, to the printing device 505. The printing device 505 discharges a liquid onto the continuous medium 510 to form an image on the continuous medium 510. The dryer 507 dries the continuous medium 510. The ejector 509 ejects the continuous medium 510.

The continuous medium 510 is fed from a winding roller 511 of the feeder 501, guided and conveyed with rollers of the feeder 501, the guide conveyor 503, the dryer 507, and wound around a take-up roller 591 of the ejector 509.

In the printing device 505, the continuous medium 510 is conveyed on a conveyance guide so as to face a head unit 550 and a head unit 555. An image is formed with the liquid discharged from the head unit 550, and post-processing is performed with a treatment liquid discharged from the head unit 555.

Here, the first head unit 550 includes, for example, four color full-line head arrays 551A, 551B, 551C, and 551D from the upstream side in the conveyance direction (a direction from right to left in FIG. 13) of the continuous medium 510. Hereinafter, the full-line head arrays 551A, 551B, 551C, and 551D are simply and collectively referred to as "head array 551" when colors are not distinguished.

Each of the head arrays 551 is a liquid discharge device to discharge liquid of black (K), cyan (C), magenta (M), and yellow (Y) onto the continuous medium 510 conveyed in the conveyance direction of the continuous medium 510. Note that number and types of color are not limited to the above-described four colors of K, C, M, and Y and may be any other suitable number and types.

In each head arrays 551, for example, as illustrated in FIG. 14, heads 100 are staggered on a base 552 to form the head array 551. Note that the configuration of the head array 551 is not limited to such a configuration. The head 100 has a configuration of one of the head 100 illustrated in FIGS. 1 to 12.

Figure 15:
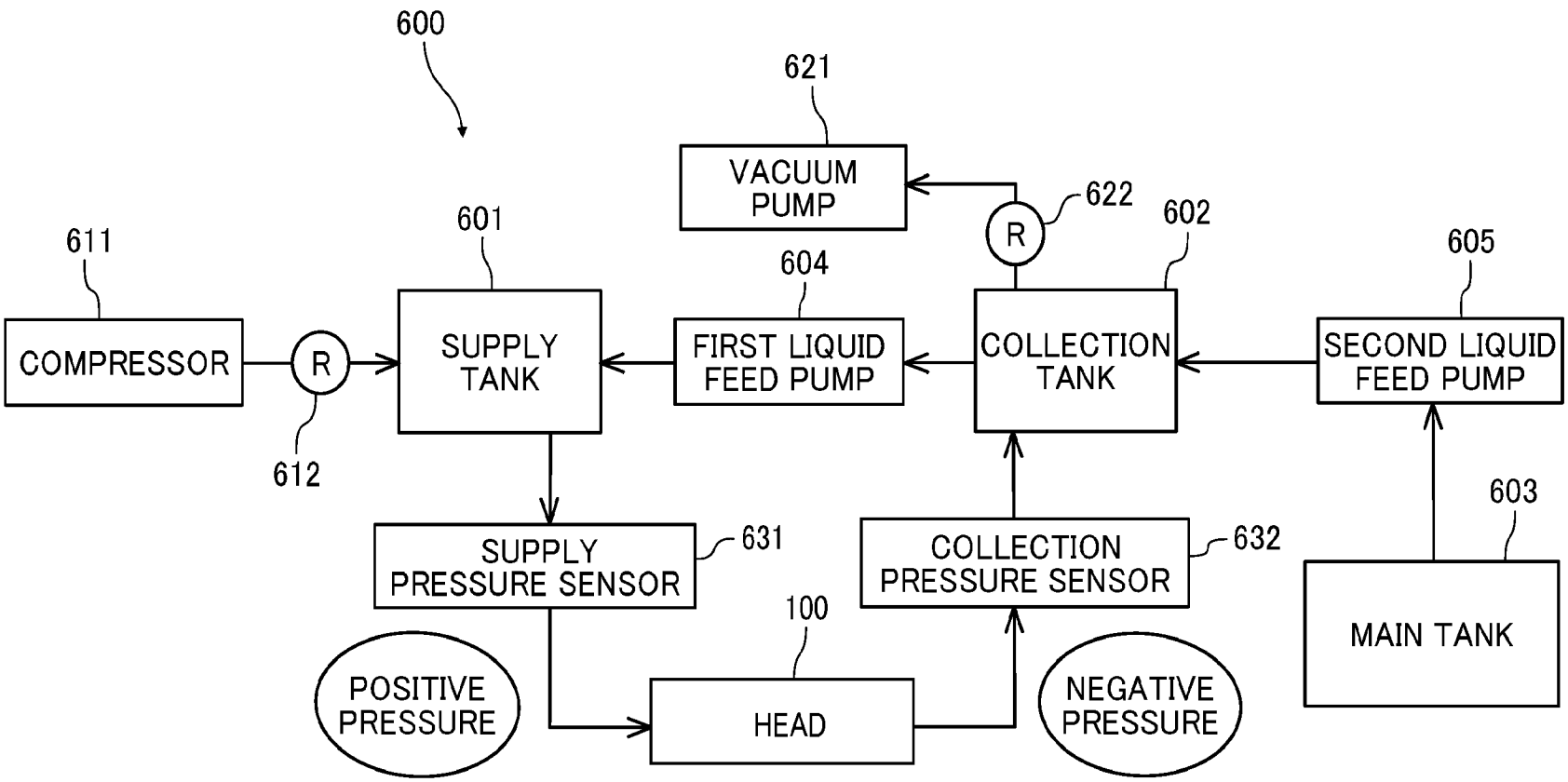
FIG. 15 is a circuit diagram of a liquid circulating apparatus according to an embodiment of the present disclosure.

FIG. 15 illustrates an example of a liquid circulation device 600 employed in the printer 500 (liquid discharge apparatus) according to the present embodiment.

FIG. 15 is a circuit diagram illustrating a structure of the liquid circulation device 600.

Although only one head 100 is illustrated in FIG. 15, in the structure including a plurality of heads 100 as illustrated in FIG. 14, supply channels and collection channels are respectively coupled via manifolds or the like to the supply sides and collection sides of the plurality of heads 100.

The liquid circulation device 600 includes a supply tank 601, a collection tank 602, a main tank 603, a first liquid feed pump 604, a second liquid feed pump 605, a compressor 611, a regulator 612, a vacuum pump 621, a regulator 622, a supply pressure sensor 631, a collection pressure sensor 632, and the like.

The compressor 611 and the vacuum pump 621 together generate a pressure difference between the pressure in the supply tank 601 and the pressure in the collection tank 602.

The supply pressure sensor 631 is between the supply tank 601 and the head 100 and connected to the supply channels connected to the ink supply port 83 (see FIG. 8) of the head 100. The collection pressure sensor 632 is between the head 100 and the collection tank 602 and connected to the collection channel connected to the ink discharge port 84 (see FIG. 8) of the head 100.

One end of the collection tank 602 is coupled to the supply tank 601 via the first liquid feed pump 604, and another end of the collection tank 602 is coupled to the main tank 603 via the second liquid feed pump 605.

Accordingly, the liquid flows from the supply tank 601 into the head 100 through the ink supply port 83. Then, the liquid is collected from the ink discharge port 84 to the collection tank 602 and is sent from the collection tank 602 to the supply tank 601 by the first liquid feed pump 604, thereby forming a circulation path through which the liquid circulates.

Here, the compressor 611 is connected to the supply tank 601 and is controlled so that a predetermined positive pressure is detected by the supply pressure sensor 631. Conversely, a vacuum pump 621 is connected to the collection tank 602 and is controlled so that a predetermined negative pressure is detected by the collection pressure sensor 632.

Such a configuration allows the menisci of ink in the head 100 to be maintained at a constant negative pressure while circulating liquid through the inside of the head 100.

When liquid droplets are discharged from the nozzles 4 of the head 100, the amount of liquid in each of the supply tank 601 and the collection tank 602 decreases. Accordingly, the collection tank 602 is replenished with the liquid fed from the main tank 603 by the second liquid feed pump 605.

The timing of supply of liquid from the main tank 603 to the collection tank 602 can be controlled in accordance with a result of detection by a liquid level sensor in the collection tank 602. For example, the liquid is supplied from the main tank 603 to the collection tank 602 when the liquid level in the collection tank 602 becomes lower than a predetermined height.

Next, another example of a printer 500 serving as a liquid discharge apparatus according to another embodiment of the present disclosure is described with reference to FIGS. 16 and 17.

Figure 16:
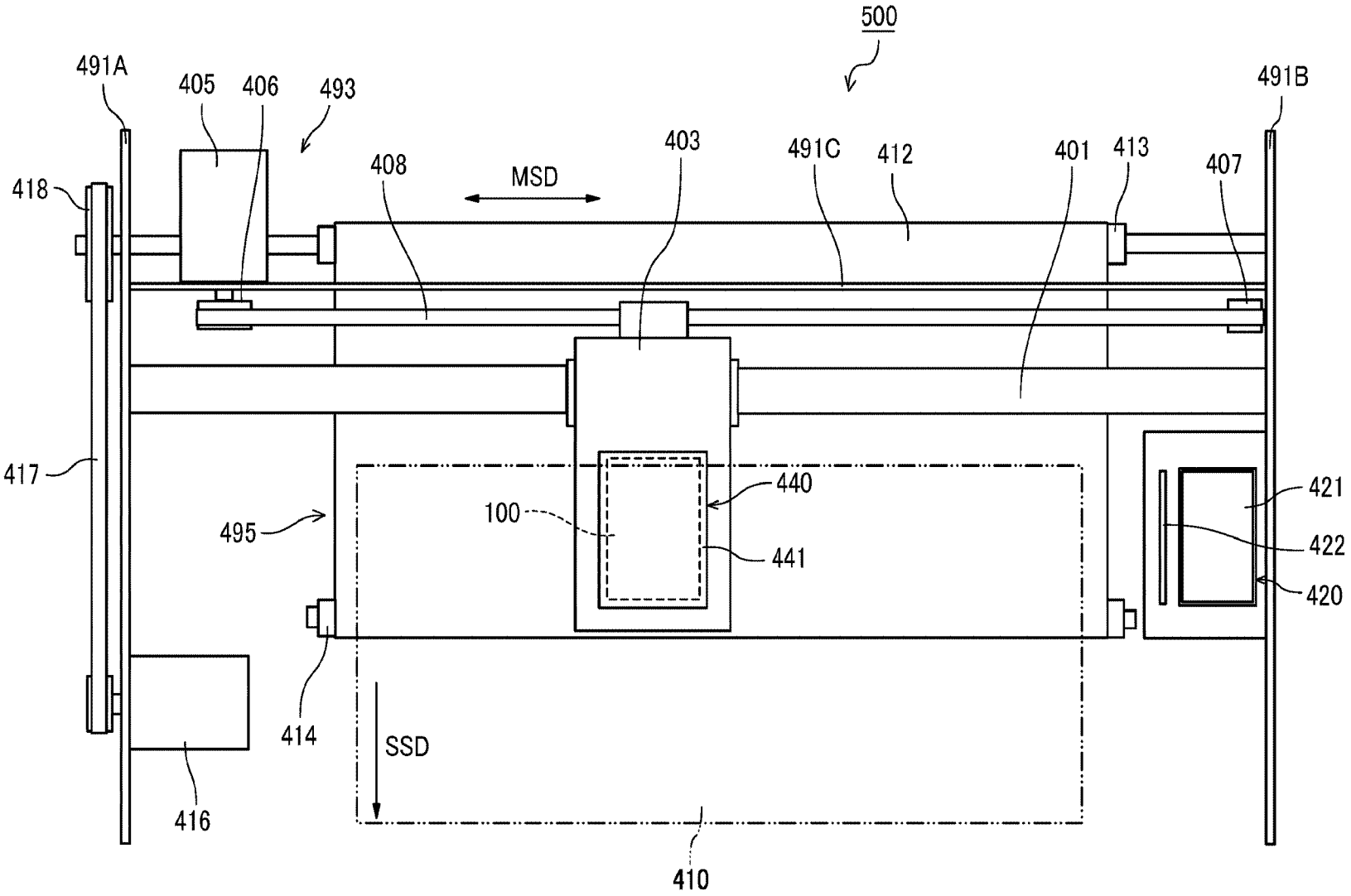
FIG. 16 is a schematic plan view of another embodiment of the liquid discharge apparatus.

FIG. 16 is a plan view of a portion of the printer 500.

Figure 17:
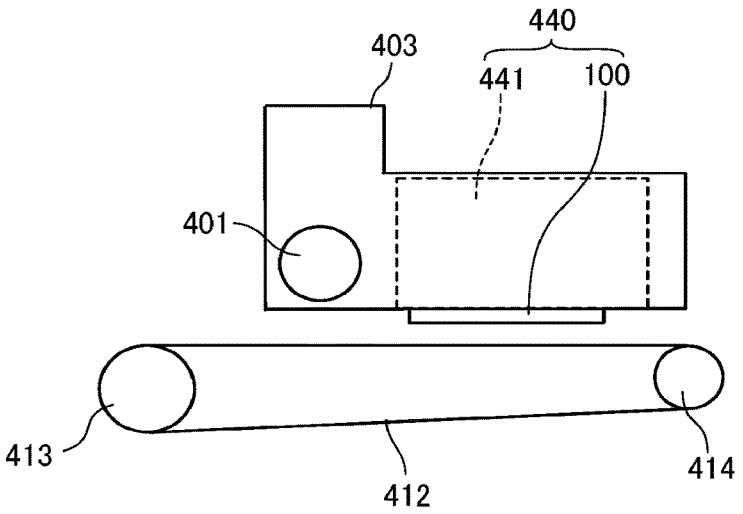
FIG. 17 is a schematic side view of another example of the liquid discharge apparatus of FIG. 16.

FIG. 17 is a side view of a portion of the printer 500 of FIG. 16.

The printer 500 is a serial type inkjet recording apparatus, and a carriage 403 is reciprocally moved in a main scanning direction indicated by arrow "MSD" in FIG. 16 by a main scan moving unit 493. The main scan moving unit 493 includes a guide 401, a main scan motor 405, a timing belt 408, and the like. The guide 401 is bridged between a left side plate 491A and a right-side plate 491B to moveably hold the carriage 403. The main scan motor 405 reciprocally moves the carriage 403 in the main scanning direction MSD via the timing belt 408 bridged between a drive pulley 406 and a driven pulley 407.

The carriage 403 mounts a liquid discharge device 440. The head 100 and a head tank 441 forms the liquid discharge device 440 as a single unit. The head 100 has a configuration of one of the head 100 illustrated in FIGS. 1 to 12. The head 100 of the liquid discharge device 440 discharges color liquids of, for example, yellow (Y), cyan (C), magenta (M), and black (K). The head 100 includes a nozzle array including the plurality of nozzles 4 arrayed in row in a sub scanning direction indicated by arrow "SSD" perpendicular to the main scanning direction MSD in FIG. 16. The head 100 is mounted to the carriage 403 so that liquid droplets (ink droplets) are discharged downward from the nozzles 4.

The head 100 is connected to a liquid circulation device 600 as described above so that a liquid of a required color is circulated and supplied.

The printer 500 includes a conveyor 495 to convey a sheet 410. The conveyor 495 includes a conveyance belt 412 as a conveyor and a sub scan motor 416 to drive the conveyance belt 412.

The conveyance belt 412 attracts the sheet 410 and conveys the sheet 410 at a position facing the head 100. The conveyance belt 412 is an endless belt stretched between a conveyance roller 413 and a tension roller 414. Attraction of the sheet 410 to the conveyance belt 412 may be applied by electrostatic adsorption, air suction, or the like.

The conveyance belt 412 rotates in the sub scanning direction SSD as the conveyance roller 413 is rotationally driven by the sub scan motor 416 via the timing belt 417 and the timing pulley 418.

At one side in the main scanning direction MSD of the carriage 403, a maintenance unit 420 to maintain the head 100 in good condition is disposed on a lateral side (right side in FIG. 16) of the conveyance belt 412.

The maintenance unit 420 includes, for example, a cap 421 to cap a nozzle surface of the head 100, a wiper 422 to wipe the nozzle surface, and the like. The nozzle surface is an outer surface of the nozzle plate 1 (see FIGS. 11 and 12) on which the nozzles 4 are formed.

The main scan moving unit 493, the maintenance unit 420, and the conveyor 495 are mounted to a housing that includes a left side plate 491A, a right-side plate 491B, and a rear side plate 491C.

In the printer 500 thus configured, the sheet 410 is conveyed on and attracted to the conveyance belt 412 and is conveyed in the sub scanning direction SSD by the cyclic rotation of the conveyance belt 412.

The head 100 is driven in response to image signals while the carriage 403 moves in the main scanning direction MSD, to discharge liquid to the sheet 410 stopped, thus forming an image on the sheet 410.

Next, the liquid discharge device 440 according to another embodiment of the present disclosure is described with reference to FIG. 18.

Figure 18:
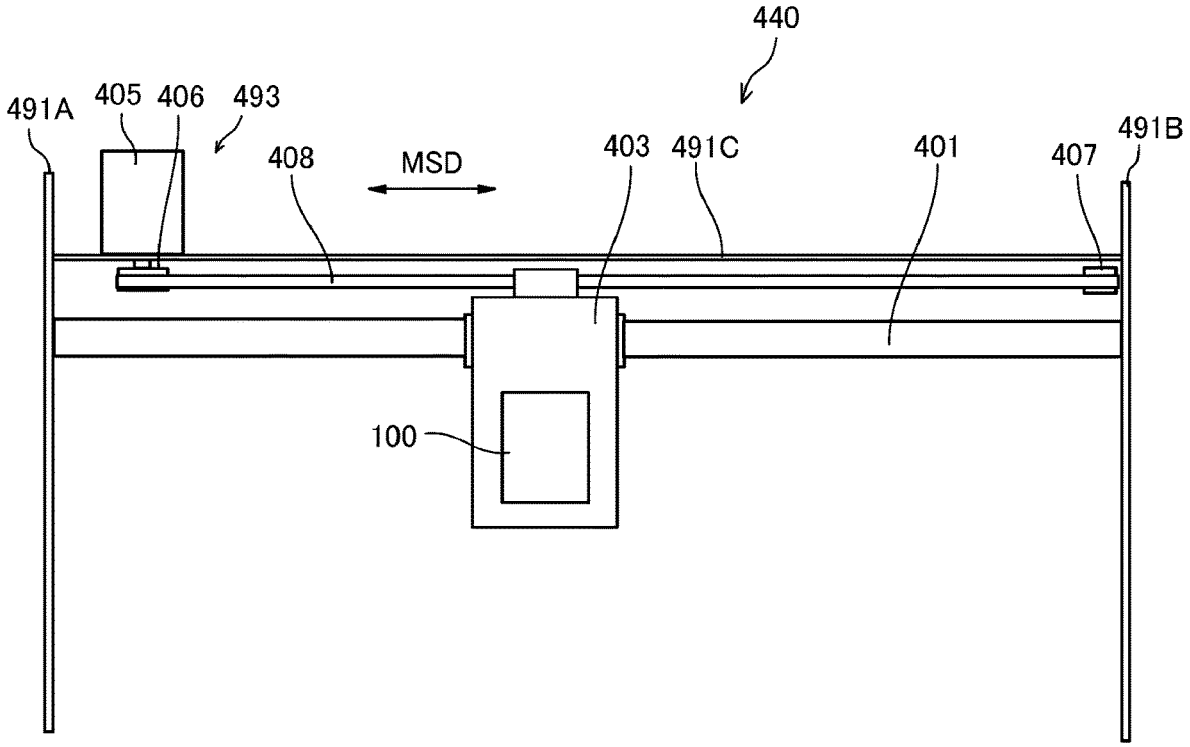
FIG. 18 is a schematic plan view of a liquid discharge device according to an embodiment of the present disclosure.

FIG. 18 is a plan view of a portion of the liquid discharge device 440 according to another embodiment of the present disclosure.

The liquid discharge device 440 includes a housing, the main scan moving unit 493, the carriage 403, and the head 100 among components of the printer 500 in FIG. 16. The left side plate 491A, the right-side plate 491B, and the rear side plate 491C constitute the housing.

Note that, in the liquid discharge device 440, the maintenance unit 420 described above may be mounted on, for example, the right-side plate 491B.

Next, still another example of the liquid discharge device 440 according to the present embodiment is described with reference to FIG. 19.

Figure 19:
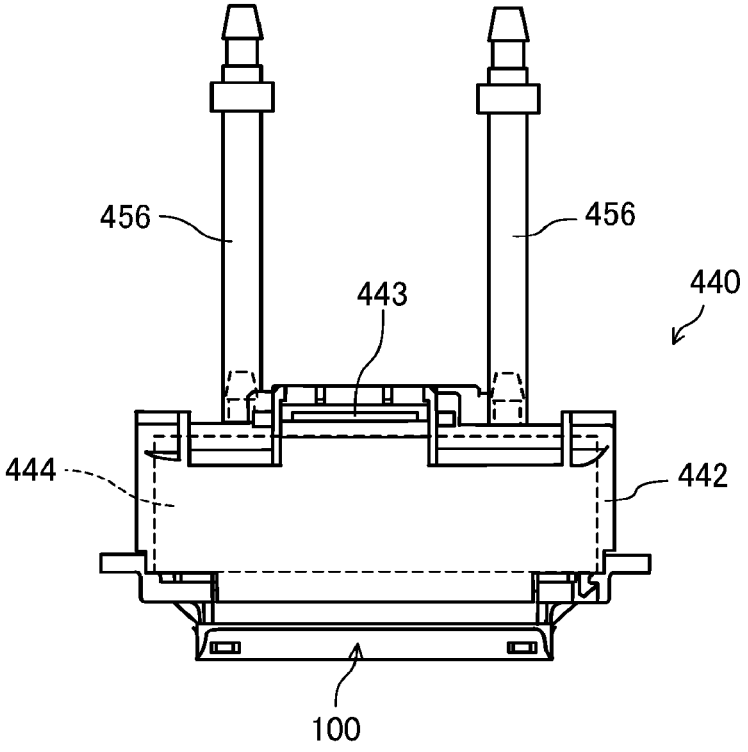
FIG. 19 is a schematic front view of the liquid discharge device according to still another embodiment of the present disclosure.

FIG. 19 is a front view of still another example of the liquid discharge device 440.

The liquid discharge device 440 includes the head 100 to which a channel part 444 is attached, and a tube 456 connected to the channel part 444.

Further, the channel part 444 is disposed inside a cover 442. In some embodiments, the liquid discharge device 440 may include the head tank 441 instead of the channel part 444. A connector 443 electrically connected with the head 100 is provided on an upper part of the channel part 444.

In the present embodiments, a "liquid" discharged from the head is not particularly limited as long as the liquid has a viscosity and surface tension of degrees dischargeable from the head.

Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge.

The term "liquid discharge device" represents a structure including the head and a functional part(s) or unit(s) combined to the head to form a single unit.

For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another.

The head may be detachably attached to the functional part(s) or unit(s) s each other.

For example, the head and the head tank may form the liquid discharge device as a single unit.

Alternatively, the head and the head tank coupled (connected) with a tube or the like may form the liquid discharge device as a single unit.

Here, a unit including a filter may further be added to a portion between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit.

The liquid discharge device may include the head, the carriage, and the main scan moving unit that form a single unit.

In still another example, a cap that forms a part of a maintenance unit may be secured to the carriage mounting the head so that the head, the carriage, and the maintenance unit form a single unit to form the liquid discharge device.

Further, in another example, the liquid discharge device includes a tube connected to the head mounting the head tank or the channel part so that the head and a supply unit form a single unit.

Liquid is supplied from a liquid reservoir source to the head via the tube.

The main scan moving unit may be a guide only.

The supply unit may be a tube(s) only or a loading unit only.

The term "liquid discharge apparatus" used herein also represents an apparatus including the head or the liquid discharge device to drive the head to discharge a liquid. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material onto which liquid at least temporarily adheres, a material onto which liquid adheres and fixes, or a material onto which liquid adheres to permeate.

Examples of the "material onto which liquid can adhere" include recording media such as a paper sheet, recording paper, and a recording sheet of paper, film, and cloth, electronic components such as an electronic substrate and a piezoelectric element, and media such as a powder layer, an organ model, and a testing cell.

The "material onto which liquid can adhere" includes any material on which liquid adheres unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere.

However, the liquid discharge apparatus is not limited to such an apparatus.

For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used in the present embodiments may be used synonymously with each other.

The head 100 according to the present embodiment can prevent the ink to be contact with the electrical connection without increasing cost.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a head body to discharge a liquid;

a head cover covering at least a part of the head body, the head cover disposed outside the head body;

a liquid supply port on an upper surface of the head cover to supply the liquid to the head body; and an electrical connection on a side surface of the head cover, wherein the head cover includes a protruding structure protruding from the upper surface of the head cover, the protruding structure is on a side end of the upper surface of the head cover adjacent to the side surface of the head cover on which the electrical connection is disposed, the protruding structure is higher than another part of the upper surface of the head cover with respect to a lower end surface of the head body, the electrical connection is inside the head cover, and the head cover includes an opening through which a connector is connectable to the electrical connection.

2. The liquid discharge head according to claim 1, wherein the protruding structure includes a step along the side end of the upper surface of the head cover.

3. The liquid discharge head according to claim 1, wherein the liquid supply port is on said another part of the upper surface of the head cover.

4. The liquid discharge head according to claim 2, wherein the protruding structure includes another step along another side end of the upper surface of the head cover different from the side end adjacent to the side surface on which the electrical connection is disposed.

5. The liquid discharge head according to claim 1, wherein the protruding structure includes a step along a periphery of the upper surface of the head cover, and the step surrounds the liquid supply port.

6. The liquid discharge head according to claim 5, further comprising a protector to protect a terminal surface of the electrical connection.

7. The liquid discharge head according to claim 1, further comprising a sealing structure to seal a gap between the connector connected to the electrical connection and a portion of the head cover around the opening.

8. The liquid discharge head according to claim 7, wherein the sealing structure includes a slit, and the connector is connectable to the electrical connection via the slit.

9. The liquid discharge head according to claim 1, further comprising:

a liquid discharge port on the upper surface of the head cover to discharge the liquid from the liquid discharge head.

10. A liquid discharge device comprising the liquid discharge head according to claim 1.

11. The liquid discharge device according to claim 10, further comprising at least one of:

a head tank to store the liquid to be supplied to the liquid discharge head;

a carriage mounting the liquid discharge head;

a supply structure to supply the liquid to the liquid discharge head;

a maintenance structure to maintain the liquid discharge head; and a main scan mover to move the carriage in a main scanning direction, wherein the liquid discharge head and said at least one of the head tank, the carriage, the supply structure, the maintenance structure, and the main scan mover form a single unit.

12. A liquid discharge apparatus comprising the liquid discharge device according to claim 10.

13. A liquid discharge head comprising:

a head body to discharge a liquid;

a head cover covering at least a part of the head body, the head cover disposed outside the head body;

a liquid supply port on an upper surface of the head cover to supply the liquid to the head body; and an electrical connection on a side surface of the head cover, wherein the head cover includes a protruding structure protruding from the upper surface of the head cover, the protruding structure is on a side end of the upper surface of the head cover adjacent to the side surface of the head cover on which the electrical connection is disposed, the protruding structure is higher than another part of the upper surface of the head cover with respect to a lower end surface of the head body, the protruding structure includes a step along the side end of the upper surface of the head cover and another step along another side end of the upper surface of the head cover different from the side end adjacent to the side surface on which the electrical connection is disposed.

14. A liquid discharge head comprising:

a head body to discharge a liquid;

a head cover covering at least a part of the head body, the head cover disposed outside the head body;

a liquid supply port on an upper surface of the head cover to supply the liquid to the head body;

an electrical connection on a side surface of the head cover; and a liquid discharge port on the upper surface of the head cover to discharge the liquid from the liquid discharge head, wherein the head cover includes a protruding structure protruding from the upper surface of the head cover, the protruding structure is on a side end of the upper surface of the head cover adjacent to the side surface of the head cover on which the electrical connection is disposed, and the protruding structure is higher than another part of the upper surface of the head cover with respect to a lower end surface of the head body.

* * * * *